US005671895A

United States Patent [19]

Cederholm et al.

[11] Patent Number: 5,671,895

[45] Date of Patent: Sep. 30, 1997

[54] SYSTEM AND METHOD FOR CONTROLLING THE SPEED AND TENSION OF AN UNWINDING RUNNING WEB

[75] Inventors: Roger Cederholm, Roscoe; James K. Ward, Rockton; Emil G. Borys, Rockford, all of Ill.

[73] Assignee: Martin Automatic, Inc., Rockford, Ill.

[21] Appl. No.: 612,268

[22] Filed: Mar. 7, 1996

[51] Int. Cl.[6] ..... B65H 19/14; B65H 23/08; B65H 23/185

[52] U.S. Cl. ..... 242/420.6; 242/421.7; 242/552; 242/554.5

[58] Field of Search ..... 242/420.6, 420.5, 242/421.7, 552, 554.5, 554.6, 559.3

[56] References Cited

U.S. PATENT DOCUMENTS

| | | | |
|---|---|---|---|
| 3,250,488 | 5/1966 | Prager | 242/554.5 |
| 3,669,375 | 6/1972 | Bruton | 242/421.7 |
| 3,822,838 | 7/1974 | Butler et al. | 242/552 |
| 4,190,483 | 2/1980 | Ryan et al. | 242/552 |
| 4,256,270 | 3/1981 | Lee et al. | 242/421.7 |
| 4,278,213 | 7/1981 | Rubruck | 242/420.6 |
| 4,899,945 | 2/1990 | Jones | 242/420.6 |
| 5,335,870 | 8/1994 | Martin | 242/555.4 |

*Primary Examiner*—John M. Jillions
*Attorney, Agent, or Firm*—McAndrews, Held & Malloy, Ltd.

[57] ABSTRACT

A system and method for controlling the speed and tension of a web being unwound from a rotating roll and being run through an inertia-compensated festoon and then to a web-using production process which requires the web to run at a preselected relatively high speed and a preselected relatively low tension. Based on sensing the amount of web stored in the festoon, a brake applies a decreasing braking-force to the running roll as the diameter of the roll decreases. When the roll has decreased to an intermediate diameter, where the decreasing tension torque is inadequate to continue to accelerate the roll, a motor engages the roll and adds assisting web-unwinding torque to the roll as the diameter of the roll continues to decrease. The brake is also used to brake the roll to a stop before a subsequent zero-speed web-splice. The motor is also used to rotate the roll to line speed after splicing.

10 Claims, 1 Drawing Sheet

SYSTEM AND METHOD FOR CONTROLLING THE SPEED AND TENSION OF AN UNWINDING RUNNING WEB

BACKGROUND OF THE INVENTION

The present invention relates to an improved system and method for controlling the speed and tension of a running web being unwound from a roll. More particularly, it relates to an improved system and method for controlling the web speed and tension of an unwinding running web where the web runs from the roll to a web-using process such as, for example, a disposable diaper manufacturing line, which requires non-woven webs to run at a preselected, relatively high speed and at a preselected, relatively low tension.

Generally speaking, lines for producing disposable diapers and similar personal hygiene products are run at the highest possible speed to maximize production efficiencies, and the non-woven webs employed in such lines are required to be run at relatively low tensions so as to enable the lines to produce a quality product. Because of this, simple, conventional braked web roll unwind systems, such as those used in other industries, were not adequate for such lines.

The recognized inadequacies of the simple brake unwind systems led those working in the art to develop and implement surface belt driven, web-roll unwind systems. While adding a level of sophistication, vis-a-vis simpler braked unwind systems, the "drive" requirements for the surface-belt, web-driven unwind systems were still relatively simple because the surface belt ran against the outside diameter of the web roll and merely had to follow the main line web speed. Most of the early surface belt driven unwind systems utilized a single belt with two unwind positions, and required the operator to perform a "drop splice". Later systems, however, utilized dual belts with "flying splice" capabilities.

User dissatisfaction with surface-belt-driven web-unwind systems arose because of the waste generated from the long web tails and because of large web tension disturbances which occurred during splicing. The web materials were also becoming much more sophisticated and were much more difficult to splice reliably. As a result, the webs were required to be run at even lower tensions.

Because of the splicing problem, zero-speed splicing systems became the preferred splicing method. Such zero-speed splicing systems utilized a web storage festoon or accumulator so as to decelerate and stop the running web roll, to allow a splice to be made between the running web and the web of a new roll, and then to accelerate the new roll back to line speed without slowing the main process or production line. The ability to splice the web, while the web was stopped, greatly improved splicing reliability.

Some zero-speed splicing systems continued to incorporate surface belt drives. But the art, by and large, shifted to center-core-shaft drives as newer web materials became increasingly difficult to unwind, by means of surface-drives, because they were narrower, more delicate, more susceptible to damage and more difficult to wind into a "hard" roll.

The use of center-core-shaft drives addressed the problems posed by the newer web materials but added a much higher level of sophistication to the control and braking systems used. More specifically, the center-core-shaft drives had to be designed to accommodate the changing diameter of the unwinding web roll as well as variations in the roundness of the roll. These systems also had to accommodate line acceleration and decelerations, as well as to provide proper accelerations and deceleration parameters during a splice. All of this led to the development and use of center-core-shaft drive systems that were more and more complicated and expensive.

SUMMARY OF THE INVENTION

In principal aspects, the improved running web speed and tension controlling system and method of the present invention represents a simple, less complicated, more cost effective alternative to the center-core-shaft drive systems presently being used. An important part of this improved system is the use of an inertia-compensated festoon or web accumulator that permits running web to accumulate in and be withdrawn from the festoon without inducing tension variations in the running web. The improved system of the present invention may be used with complex or relatively basic production lines with equal facility. Installation is simple and can be done expeditiously. Additionally, the improved system may be readily repaired if it should, for some reason, malfunction.

Accordingly, a primary object of the present invention is to provide an improved method and system for controlling the speed and tension of a web being unwound from a rotating roll, where the web runs from the roll along a predetermined path to and through an inertia-compensated festoon, which has the capacity of storing varying amounts of running web during operation, to a web-using process such as, for example, a disposable diaper manufacturing line, which requires a non-woven web to run at a preselected relatively high speed and a preselected relatively low tension; and which tends to pull the web so as to apply a web unwinding torque to the roll.

Another object of the present invention is to provide an improved method, as described, including the steps of: supplying a braking force or torque to the rotating roll when the web begins to unwind from the roll for controlling the speed and tension of the running web; decreasing the braking force applied to the roll as the diameter of the running roll is reduced, due to the web being unwound from the roll, such that the web will run through the process at the preselected speed and tension as the roll unwinds; and when the roll has been unwound to an intermediate diameter where decreasing web-unwinding torque from the web is inadequate to continue to accelerate the mass of the roll and of the other rotating components such that stored web begins to be fed out of the festoon, assisting in unwinding the roll by adding web-unwinding torque to the roll as the diameter of the roll continues to decrease from the intermediate diameter so that the web will continue to run through the process at the preselected speed and tension as the remaining web is unwound from the roll.

Still another object of the present invention is to provide an improved system, as described, where the system comprises: a first-web roll mounted for rotation so that the unwinding running-web runs along a predetermined path from the roll to the process; an inertia-compensated festoon that is disposed in the predetermined path of the running web and that has the capacity for storing varying amounts of running-web during the operation of the process; a brake assembly that is connected with the roll for applying a braking force or torque to the roll; a shaft-drive assembly that is connected with the roll so that, when engaged, the drive assembly can drive or add an assisting, web-unwinding driving force to the roll in a web-unwinding direction; and a controller that controls the operation of the brake assembly and the drive assembly (a) to cause the brake assembly to apply a decreasing braking force to the roll as the diameter of the roll decreases while the web continues to be unwound from the roll such that the web will run through the process at the preselected speed and tension; and (b) when the roll has been unwound to an intermediate diameter such that the decreasing web-unwinding torque of the web is inadequate to continue to accelerate the mass of the roll and the components rotating therewith such that stored web begins to feed out of the festoon, then to cause the drive assembly to engage the roll and add web-unwinding torque to the roll to assist in unwinding the web as the diameter of the roll continues to decrease from the intermediate diameter such that the web will continue to run through the process at the preselected speed and tension as the remaining web is unwound from the roll.

A further object of the present invention is to provide an improved system and method, as described, where the amount of running web stored in the festoon determines the application of the braking force to be applied to the roll and the adding of the web-unwinding torque, by the drive assembly, to the roll.

A still further object of the present invention is to provide an improved system and method, as described, where the controller also causes the brake assembly to bring the running roll to a stop when a web splice is to be made by a zero-speed splicing assembly and then causes the drive assembly, associated with the new web roll, to bring the new running roll up to line speed; and the braking-assembly associated with the new roll, to apply braking force to the new roll so as to control the speed of the web running from the new roll.

These and other objects, advantages and benefits of the present invention will become more apparent from the following description of the preferred embodiment of the present invention, which description may be best understood with reference to the accompanying drawing.

DESCRIPTION OF THE PREFERRED EMBODIMENT

Figure 1:
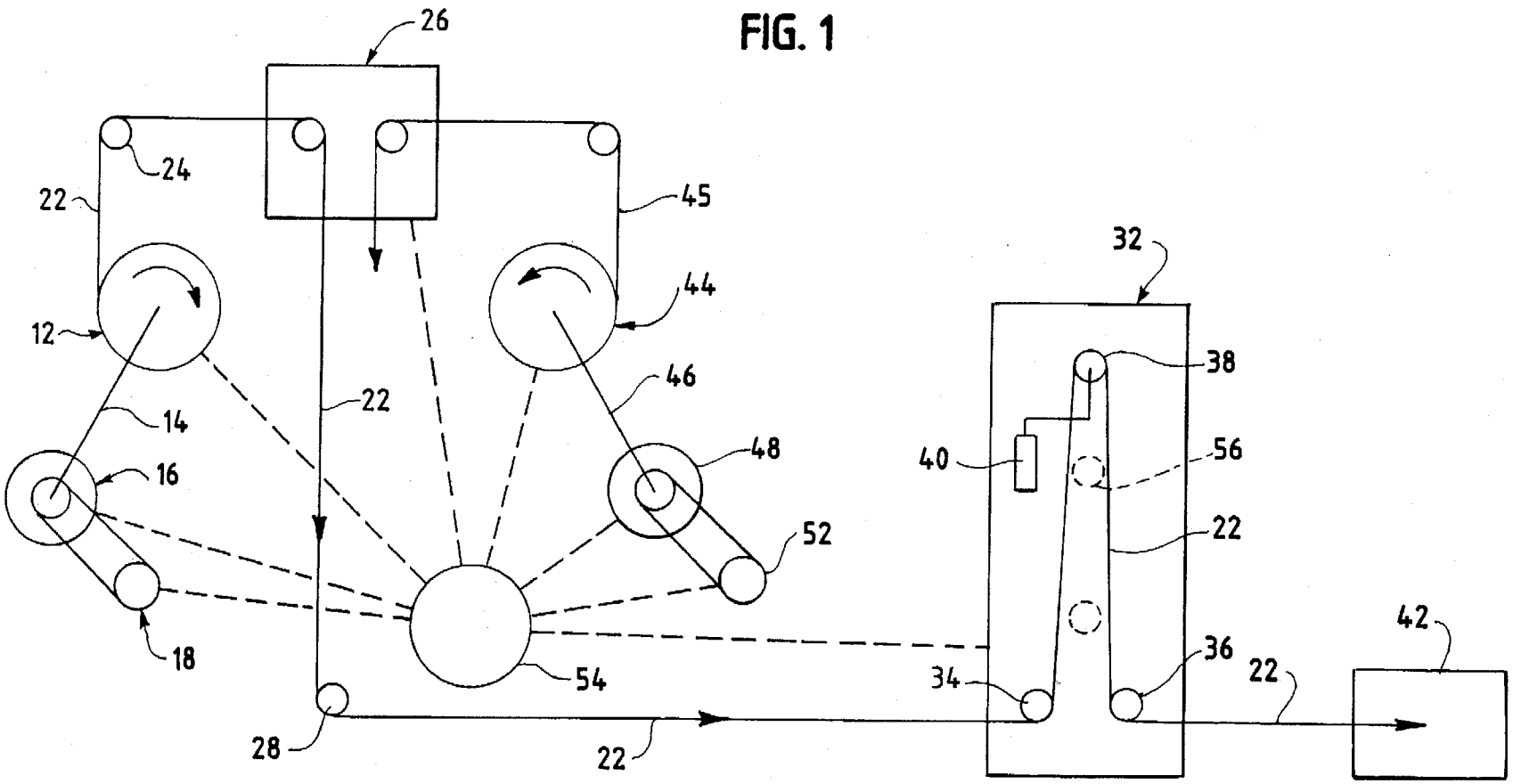
FIG. 1 is a schematic view of the preferred embodiment of the improved system of the present invention.

Referring to FIG. 1, the preferred embodiment of the improved system of the present invention includes a first, conventional roll 12 of web material which may be, for example, a non-woven material. The roll 12 is mounted for rotation about a conventional center-core-shaft 14. A conventional disk-brake assembly 16 is mounted on the shaft 14 and may be used selectively to apply braking force or torque to the shaft 14. The brake assembly may be as disclosed in U.S. Pat. No. 5,335,870. For a typical web roll used in a typical production line, a 1, 2 or 3 h.p. brake assembly may be used.

A conventional shaft-drive assembly 18 is also connected to the center-core-shaft 14 for applying torque to the shaft. The drive assembly may include a 3-phase AC or a DC tendency motor. A 1, 2 or 3 h.p. motor may be employed, for example, with a typical roll which is used in connection with a typical production line. The motor may be connected with the shaft 14 by means of a V-belt and pulley arrangement. The assemblies 16 and 18 may cooperate as disclosed in U.S. Pat. No. 5,335,870.

When the roll 12 is rotated, as for example, in the clockwise direction shown in FIG. 1, the web 22 on the roll will be unwound. The unwinding, running-web 22 passes around an idler 24 to a conventional zero-speed splicing assembly 26. After passing through the assembly 26, the web 22 continues, around another idler 28, to a conventional, inertia-compensated festoon or web accumulating assembly 32. The festoon 32 is capable of storing various quantities of the running-web depending on the operation of the system.

In simplified form, the festoon 32 includes fixed entry and exit idlers 34 and 36, respectively, and a movable dancer 38. As shown in FIG. 1, the dancer 38 is movable vertically, with respect to the idlers 34 and 36, depending on the amount or quantity of running-web being stored in the festoon. A larger or greater quantity of running-web 22 is being stored in the festoon when the dancer 38 is at a higher position, that is, the position illustrated in FIG. 1, than when the dancer is lower, that is, vertically closer to the idlers 34 and 36 as shown at 39. As is typical with such festoons, an air cylinder assembly 40 is used to urge the dancer 38 to its uppermost position.

In the conventional manner, the running-web 22 passes about the idler 34, the dancer 38, and the idler 36 before passing out of the festoon and then to a conventional web-using process or manufacturing line 42. An example of such a process or line is one for producing disposable diapers or similar personal-hygiene products in which the web 22 is required to run at a relatively high speed and relatively low tension on a relatively continuous basis. Examples of such production line web speeds and tensions are 800–1000 feet per minute and 1–6 pounds, respectively.

The system of the present invention also includes at least one other web roll 44 having a web 45 wound therein. In a manner substantially, structurally and functionally identical to that of roll 12, the roll 44 mounted for rotation on a conventional center-core-shaft 46. Similarly, a conventional brake assembly 48 is mounted on the shaft 46 so as to be able to apply a braking force to the roll 44 through the shaft. Like the drive-assembly 18, a drive-assembly 52 is also connected with the shaft 46.

A conventional controller 54 is connected with the rolls 12, 44, the assemblies 16, 18, 48 and 52, the assembly 26, and the festoon 32 so as to be able to control the system as hereinafter described.

During the initial, steady running of the web 22, the tension in the web, resulting from the operation of the line 42, creates what may be called a web "tension torque", or web-unwinding torque, in the web as it is unwound from the roll. In other words, when the roll 12 is being unwound, the roll is being rotated or "driven" by this tension torque. During normal operation, the brake assembly 16 provides a reverse torque or braking force to the core shaft 14, and thus to the roll 12, such that a tension equilibrium is maintained in the web 22, and the web is accordingly maintained at its preselected tension and preselected speed.

The amount of braking force being applied at any point of time is controlled by the controller 54 and is based on the sensed-position of the moving dancer 38 in the festoon 32. In other words, a feedback signal from the festoon 32, based on the position of the dancer 38, controls the braking torque or braking force being applied to the shaft 14. In this regard, the more running web being stored in the festoon 32, the greater the braking torque or force being applied to the shaft 14 by the assembly 16.

In addition to providing a feedback signal based on the position of the dancer 38, the festoon 32 also provides the controller 54 with a rate-control feedback-signal. Thus, should the amount of web 22 being stored in the festoon increase quickly for some reason, an additional braking force will be applied by the assembly 16. This rate control is, however, generally not used when the amount of running web in the festoon decreases, that is, when the dancer 38 descends toward the rollers 34 and 36 as shown in FIG. 1.

As web 22 continues to unwind from the roll 12, the diameter of the roll decreases. Because the process 42, and hence the speed of the web 22, is maintained at the preselected speed, the rotative or rotational speed of the roll 12 must thus increase in accordance with the known relationship where web speed (feet per minute) is equal to $\pi$ times the rotative speed (revolutions per minute) of the roll times the diameter (in feet) of the roll. From this relationship, it is apparent that for web speed to be maintained, the rotative speed must continuously increase as the diameter of the roll decreases. More specifically, the rotative speed must increase at an exponential rate in web unwinding systems to maintain a preselected web speed. Hence, an external force (s) must be applied to the roll (or the web) to accelerate (in this case, angularly or rotatively) the mass of the roll 12 and the components of the assembly 16 and 18 that rotate with the shaft 14.

When the roll 12 is relatively large in diameter, the rate of change of its rotative speed is relatively small. As the roll unwinds, however, the festoon 32 is gradually "giving up" stored web 22; in other words, the dancer 38 is continuously lowering or descending toward the idlers 34 and 36, and is doing so at an ever increasing rate. The festoon 32 sends position feedback signals, based on the position of the dancer 38 as it descends towards the idlers 34 and 36, to the brake assembly 16, through the controller 54, causing a decreasing brake torque or force to be applied to the shaft 14 so as to balance the ever-decreasing tension torque of the web 22.

At some point of roll depletion, the diameter of the roll 12 reaches an intermediate diameter where the decreasing tension torque is not adequate to accelerate the roll and the components that rotate with the roll, as required to maintain web speed and tension. At this point, the dancer 38 has reached an intermediate position, shown at 56 in FIG. 1, and the controller 54 is programmed to activate the drive assembly 18 such that it "softly" engages the shaft 14, and thus the roll 12. The assembly 18 then begins to add web-unwinding torque to assist the running roll to continue to be accelerated. Once it is engaged, the assembly 18 will continue to assist the running roll by adding web-unwinding or drive torque until the running roll is depleted, that is, until a web splice is made. During the time that the assembly 18 is adding drive torque to the shaft, a brake force is still being applied by the braking assembly 16, via the controller 54, so as to keep the dancer 38 within the upper and lower limits of its control range; or in other words, to maintain precisely the preselected speed and preselected tension on the running web 22 as it passes to the process 42.

The controller 54 includes conventional controls for sensing when the web 22 is about to be depleted from the roll 12. When a splice is to be made, the controller 54 disengages the drive assembly 18 and actuates the brake assembly 16 so as to bring the running roll to a stop. Then the controller actuates the zero-speed splicer 26 to splice the leading end of the new web 45 to the trailing end of the running web 22 (and of course, to sever the web 22 upstream from the splice if the remaining web is not permitted to run-off the roll). The controller 54 next engages the drive assembly 52 so that the assembly will rotate the shaft 46 and bring the web 45, which is being unwound from the roll 44, to line speed. Thereafter the new web 45 will begin passing through around the idler 28, through the festoon 32 and to the process 42.

When the web 45 reaches line speed, the controller disengages the assembly 52 and causes the braking assembly 48 to control the speed of the web 45, as heretofore described with roll 12 and assembly 16, so as to maintain the web at the preselected speed and tension values.

The following copyrighted Computer "C" program is used with the controller 54:

- 27 -

```
/* sigdef.i - variable definition and initialization */

#ifdef SIGSIMU

#define defvar(n) extern splcVar n[];
#define endvar

#define definput(id,n,i) static unsigned char id;
#define defoutput(id,n,i) static unsigned char id;
#define defsystem(id,n,i) static unsigned char id;
#define defreserve(id,n,i) static unsigned char id;
#define defbtimer(id,n,i) \
 static unsigned char id##_done; \
 static unsigned char id; \
 static unsigned char id##_cons;
#define defbyted(id,n,i) static unsigned char id;
#define defbytev(id,n,i) static unsigned char id;
#define defbytek(id,n,i) static unsigned char id;
#define defbyte(id,n,i) static unsigned char id;
#define defwtimer(id,n,i) \
 static unsigned char id##_done; \
 static unsigned short id; \
 static unsigned short id##_cons;
#define defwordd(id,n,i) static unsigned char id;
#define defwordv(id,n,i) static unsigned short id;
#define defwordk(id,n,i) static unsigned short id;
#define defword(id,n,i) static unsigned short id;

#ifdef SIGINIT

#undef defvar
#undef endvar
#undef definput
#undef defoutput
#undef defsystem
#undef defreserve
#undef defbtimer
#undef defbyted
#undef defbytev
#undef defbytek
#undef defbyte
#undef defwtimer
#undef defwordd
#undef defwordv
#undef defwordk
#undef defword

#define defvar(n) splcVar n[256] = {
#define endvar {'z',0,0,0,0,""} };

#define definput(id,v,i) \
  {'i',dplcInputBase+v,0,&id,i,#id},
#define defoutput(id,v,i) \
  {'o',dplcOutputBase+v,0,&id,i,#id},
#define defsystem(id,v,i) \
  {'s',dplcSystemBase+v,0,&id,i,#id},
#define defreserve(id,v,i) \
```

- 28 -

```
  {'r',dplcResrvBase+v,0,&id,i,#id},
#define defbtimer(id,v,i) \
  {'b',dplcBytevBase+v,0,&id,0,#id}, \
  {'c',dplcBytekBase+v,0,&id##_cons,i,#id"_cons"}, \
  {'d',dplcBDoneBase+v,0,&id##_done,0,#id"_done"},
#define defbyte(id,v,i) \
  {'a',dplcByteBase+v,0,&id,i,#id},
#define defbytev(id,v,i) \
  {'b',dplcBytevBase+v,0,&id,i,#id},
#define defbytek(id,v,i) \
  {'c',dplcBytekBase+v,0,&id,i,#id},
#define defbyted(id,v,i) \
  {'d',dplcBDoneBase+v,0,&id,i,#id},
#define defwtimer(id,v,i) \
  {'w',dplcWordvBase+v,0,&id,0,#id}, \
  {'x',dplcWordkBase+v,0,&id##_cons,i,#id"_cons"}, \
  {'y',dplcWDoneBase+v,0,&id##_done,i,#id"_done"},
#define defword(id,v,i) \
  {'v',dplcWordBase+v,0,&id,i,#id},
#define defwordv(id,v,i) \
  {'w',dplcWordvBase+v,0,&id,i,#id},
#define defwordk(id,v,i) \
  {'x',dplcWordkBase+v,0,&id,i,#id},
#define defwordd(id,v,i) \
  {'y',dplcWDoneBase+v,0,&id,i,#id},

  #endif  // SIGINIT
#else

#define defvar(n) extern code splcVar n[];
#define endvar

#define definput(id,n,i) static bit unsigned char id \
 @ dplcInputBase+15-n+(n/16)*dplcInputBits;
#define defoutput(id,n,i) static bit unsigned char id \
 @ dplcOutputBase+15-n+(n/16)*dplcOutputBits;
#define defsystem(id,n,i) static bit unsigned char id @ dplcSystemBase+n;
#define defreserve(id,n,i) static bit unsigned char id @ dplcResrvBase+n;
#define defbyted(id,n,i) static bit unsigned char id @ dplcBDoneBase+n;
#define defwordd(id,n,i) static bit unsigned char id @ dplcWDoneBase+n;

#ifdef SIGSOFT

#define defbtimer(id,n,i) \
 static bit unsigned char id##_done @ dplcBDoneBase+n; \
 extern far unsigned char id; \
 extern far unsigned char id##_cons;
#define defbytev(id,n,i) extern far unsigned char id;
#define defbytek(id,n,i) extern far unsigned char id;
#define defbyte(id,n,i) extern far unsigned char id;
#define defwtimer(id,n,i) \
 static bit unsigned char id##_done @ dplcWDoneBase+n; \
 extern far unsigned short id; \
 extern far unsigned short id##_cons;
#define defwordv(id,n,i) extern far unsigned short id;
#define defwordk(id,n,i) extern far unsigned short id;
#define defword(id,n,i) extern far unsigned short id;
```

- 29 -

```
#else

#define defbtimer(id,n,i) \
 static bit unsigned char id##_done @ dplcBDoneBase+n; \
 far unsigned char id @ dplcBytevBase+n; \
 far unsigned char id##_cons @ dplcBytekBase+n;
#define defbytev(id,n,i) far unsigned char id @ dplcBytevBase+n;
#define defbytek(id,n,i) far unsigned char id @ dplcBytekBase+n;
#define defbyte(id,n,i) far unsigned char id @ dplcByteBase+n;
#define defwtimer(id,n,i) \
 static bit unsigned char id##_done @ dplcWDoneBase+n; \
 far unsigned short id @ dplcWordvBase+2*n; \
 far unsigned short id##_cons @ dplcWordkBase+2*n;
#define defwordv(id,n,i) far unsigned short id @ dplcWordvBase+2*n;
#define defwordk(id,n,i) far unsigned short id @ dplcWordkBase+2*n;
#define defword(id,n,i) far unsigned short id @ dplcWordBase+2*n;

#endif  // SIGSOFT

#ifdef SIGINIT

#undef defvar
#undef endvar
#undef definput
#undef defoutput
#undef defsystem
#undef defreserve
#undef defbtimer
#undef defbyted
#undef defbytev
#undef defbytek
#undef defbyte
#undef defwtimer
#undef defwordd
#undef defwordv
#undef defwordk
#undef defword

#define defvar(n) code splcVar n[256] = {
#define endvar {'z',0,0,0,0,""} };

#define definput(id,v,i) \
  {'i',dplcInputBase+15-v+(v/16)*dplcInputBits,0,0,i,#id},
#define defoutput(id,v,i) \
  {'o',dplcOutputBase+15-v+(v/16)*dplcOutputBits,0,0,i,#id},
#define defsystem(id,v,i) \
  {'s',dplcSystemBase+v,0,0,i,#id},
#define defreserve(id,v,i) \
  {'r',dplcResrvBase+v,0,0,i,#id},
#define defbtimer(id,v,i) \
  {'c',255,0,&id##_cons,i,#id"_cons"},
#define defbyte(id,v,i) \
  {'b',255,0,&id,i,#id},
#define defbytev(id,v,i) \
  {'b',255,0,&id,i,#id},
#define defbytek(id,v,i) \
```

```
  {'c',255,0,&id,i,#id},
#define defbyted(id,v,i) \
  {'d',dplcBDoneBase+v,0,0,i,#id},
#define defwtimer(id,v,i) \
  {'x',254,0,&id##_cons,i,#id"_cons"},
#define defword(id,v,i) \
  {'w',254,0,&id,i,#id},
#define defwordv(id,v,i) \
  {'w',254,0,&id,i,#id},
#define defwordk(id,v,i) \
  {'x',254,0,&id,i,#id},
#define defwordd(id,v,i) \
  {'y',dplcWDoneBase+v,0,0,i,#id},

#endif  // SIGINIT

#endif  // SIGSIMU

/* end of sigdef.i */
// signal.i  definitions

#include "sigdef.i"

defvar (theVar)

// inputs
definput   (i_psi,        0, off) // switch
definput   (i_stop,       1, off) // switch
definput   (i_enable,     2, off) // button
definput   (i_disable,    3, off) // button
definput   (i_toggle,     4, off) // button
definput   (i_manual,     5, off) // button
definput   (i_tension,    6, off) // switch
definput   (i_Ldoor,      7, off) // switch
definput   (i_Rdoor,      8, off) // switch
definput   (i_Cenab,      9, off) // customer
definput   (i_Cstop,     10, off) // customer
definput   (i_altref,    11, off) // switch
definput   (i_disco,     12, off) // switch

// outputs
defoutput  (Air,          0, off) // spindle air
defoutput  (Lbrake,       1, off) // control brake selects
defoutput  (Rbrake,       2, off)
defoutput  (Enable,       3, off) // splice enable
defoutput  (Lrun,         4, off) // indicators
defoutput  (Rrun,         5, off)
defoutput  (Lcut,         6, off) // cut actuators
defoutput  (Rcut,         7, off)
defoutput  (Nip,          8, off) // perform splice
defoutput  (Tension,      9, off) // enable tension
defoutput  (Wire,        10, off) // heat to wire
defoutput  (Lwire,       11, off) // wire selects
defoutput  (Rwire,       12, off)
defoutput  (Lmotor,      13, off) // control motor selects
defoutput  (Rmotor,      14, off)
defoutput  (Lrotate,     15, off) // platform rotate
```

- 31 -

```
defoutput  (Rrotate,    16, off)
defoutput  (Stop,       17, off) // unwind stopped
defoutput  (Break,      18, off) // web break
//defoutput  (NSplice,    19, off) // not splicing
defoutput  (Referr,     20, off) // reference error
defoutput  (Boost,      21, off) // motor enable
defoutput  (Torq0,      22, off) // high torque
defoutput  (Alarm,      23, off) // splice alarm

// internal bits
defsystem  (j_alarm,     0, off) // sounds alarm
defsystem  (j_heat,      1, off) // starts wire preheat
defsystem  (j_splice,    2, off) // ready for splice
defsystem  (j_zero,      3,  on) // zero speed for nip/cut
defsystem  (j_stop,      4,  on) // zero speed for nip/cut
defsystem  (j_change,    5, off) // on to change rolls
defsystem  (j_assist,    6, off) // low torque
defsystem  (j_boost,     7, off) // high torque
defsystem  (j_manual,    8, off) // wait for boost
defsystem  (j_topped,    9, off) // maybe break
defsystem  (j_stopt,    10, off) // from customer enable
defsystem  (j_end,      11, off) // from autosplice
defsystem  (s_press,    12, off) // on change spindles
defsystem  (s_hot,      13, off) // delaying wire change
defsystem  (s_wait,     14, off) // wait for boost
defsystem  (s_rotate,   15, off) // wait for table

defsystem  (d_roll,     29, off) // roll pulse
defsystem  (d_refa,     30, off) // reference pulse
defsystem  (d_ref,      31, off) // reference pulse
defsystem  (s_left,     32, off) // saved selected roll

// ladder timers
defbtimer  (t_break,     0,  -16) // determines web break op
defbtimer  (t_heat,      1,  -17) // for wire to heat up
defbtimer  (t_dwell,     2,  -18) // after cut before done
defbtimer  (t_cut,       3,  -19) // after cut before reset
defbtimer  (t_boost,     4,  -20) // after cut before reset
defbtimer  (t_rotate,    5,  -21) // after cut before reset

// pid parameters
defbyte    (ppb_rev,     0,  -64) // reverse action
defbyte    (ppb_lim,     1,  -65) // limit to saturation
defbyte    (ppb_edv,     2,  -66) // use error derivative
defbyte    (ppb_drate,   3,  -67) // pid derivative rate
defbyte    (ppb_dead,    4,  -68) // deadzone
defword    (ppw_set,     0,  -96) // setpoint position
defword    (ppw_pfact,   1,  -98) // gain
defword    (ppw_dfact,   2, -100) // deriv factor
defword    (ppw_ifact,   3, -102) // integral factor
defword    (ppw_sfact,   4, -104) // smoothing
defword    (ppw_wfact,   5, -106) // antiwindup
defword    (ppw_setw,    6, -108) // setpoint weight
defword    (ppw_sat,     7, -110) // highest output
defword    (ppw_dint,    8, -112) // default integral
defword    (ppw_lsat,    9, -114) // lowest integral
defword    (ppw_hsat,   10, -116) // highest integral
```

- 32 -

```
defword   (ppw_top,       11,  -118) // dancer topped
defword   (ppw_stop,      12,  -120) // run brake level

// assist parameters
defbyte   (pab_assist,     8,   -72) // torque adjust
defword   (paw_assoff,    16,  -128) // position
defword   (paw_asson,     17,  -130) // integral
defword   (paw_tomot,     18,  -132) // timeout boost motor
defword   (paw_break,     19,  -134) // highest deriv
defword   (paw_toolow,    20,  -136) // setpoint weight

// autosplice parameters
defbyte   (psb_acal,      12,   -76) // caliper assumption
defbyte   (psb_ical,      13,   -77) // to redo caliper
defword   (psw_refsiz,    24, -144) // reference length
defword   (psw_hotoff,    25, -146) // radius offset for heat
defword   (psw_almoff,    26, -148) // radius offset for alarm
defword   (psw_minrad,    27, -150) // to comput variable gain
defword   (psw_gain,      28, -152) // factor
defword   (psw_dgain,     29, -154) // default

// conditioning parameters
defbyte   (pcb_okct,      16,   -80) // to start line/roll
defbyte   (pcb_dead,      17,   -81) // dead line test
defbyte   (pcb_referr,    18,   -82) // percentage

// pid variables
defbyte   (vpb_force,     64,    0) // force dac out
defword   (vpw_posit,     64,    0) // position
defword   (vpw_error,     65,    0) // position
defword   (vpw_deriv,     66,    0) // derivative
defword   (vpw_integ,     67,    0) // integral/256
defword   (vpw_corr,      68,    0) // current correction

// autosplice variables
defbyte   (vsb_ref,       72,    0) // counters
defbyte   (vsb_left,      73,    0)
defbyte   (vsb_right,     74,    0)
defbyte   (vsb_refa,      75,    0)
defword   (vsw_splice,    72,    0) // from thumb
defword   (vsw_radius,    73,    0) // current radius
defword   (vsw_wrap,      74,    0) // current radius
defword   (vsw_time,      75,    0) // time to splice
defword   (vsw_calip,     76,    0) // caliper
defword   (vsw_web,       77,    0) // webspeed
defword   (vsw_gain,      78,    0) // adjusted for radius

endvar

// end of signal.i
/* ladder.h  plc functions */

extern void ladder func(unsigned char lplcstart, unsigned char lplcstep);

/* end of ladder.h */
// ladder.c  plc functions
```

- 33 -

```
#include "plc.h"
#include "signal.i"
#include "ladder.h"

#define SIGINIT
#include "signal.i"

defproc (ladder)
  getticks
  getins (theVar)

// tension from switch
  eval (i_tension)
    update (Tension)
    endrung

// show web break if topped out for too long
  eval (j_topped and not t_break_done)
    timerif (t_break)
    endrung
  eval ((t_break_done or Break) and j_topped)
    update (Break)
    endrung

// stop if splice and not enabled
  eval (j_splice and not Enable)
    update (j_end)
    endrung

// show stopped for whatever reason
  eval (not(j_end or not i_stop or not i_psi or not Tension or Break))
    update (Stop)
    endrung

// spindle air when doors closed
  eval ((not i_Ldoor) and (not i_Rdoor))
    update (Air)
    endrung

// rotate on button and doors closed until cut done
  eval ((i_enable or s_rotate) and Air and i_stop and i_disco and not t_cut_done
and not i_disable)
    timerif (t_rotate)
    update (s_rotate)
    endrung

// wait for table in place before enable
  eval (s_rotate and (t_rotate_done or Enable))
    update (Enable)
    endrung

// rotate platforms on not enable if not running roll and
  eval (not s_rotate and not s_left)
    update (Lrotate)
    endrung
  eval (not s_rotate and s_left)
    update (Rrotate)
```

```
    endrung

// sound alarm
  eval (j_alarm and not Enable and not (i_toggle or j_change))
    update (Alarm)
    update (j_alarm)
    endrung

// toggle roll on button or change
  eval (((i_toggle and j_zero) or j_change) and not s_press)
    togif (s_left)
    endrung
  eval (i_toggle or j_change)
    update (s_press)
    endrung

// show manual splice on button
  eval ((i_manual or j_manual) and Enable and not t_dwell_done)
    update (j_manual)
    endrung

// start heat on manual or signal until after cut if enabled
  eval (j_manual or j_heat)
    update (j_heat)
    endrung
  eval ((j_manual or j_heat) and Enable)
    update (Wire)
    endrung

// show splice on manual until after dwell
  eval ((j_manual or j_splice) and not (i_toggle or t_dwell_done) and Enable)
    update (j_splice)
    endrung

// select correct controls
  eval (s_left)
    update (Lbrake)
    update (Lmotor)
    update (Lrun)
    endrung
  eval (not s_left)
    update (Rbrake)
    update (Rmotor)
    update (Rrun)
    endrung

// delay wire change while on
  eval ((not Wire and s_left) or (Wire and not Rwire))
    update (Lwire)
    endrung
  eval ((not Wire and not s_left) or (Wire and not Lwire))
    update (Rwire)
    endrung

// timed preheat
  eval (j_heat and not t_heat_done)
    timerif (t_heat)
```

```
    endrung
  eval ((t_heat_done or s_hot) and Wire)
    update (s_hot)
    endrung

// start splice only if hot until cut done
  eval ((j_splice and s_hot and Enable))
    update (j_change)
    endrung

// start nip at zero speed and dwell
  eval (((j_change and j_zero) or Nip) and not t_dwell_done)
    timerif (t_dwell)
    update (Nip)
    endrung

// wait after release for boost
  eval ((t_dwell_done or s_wait) and not t_boost_done)
    timerif (t_boost)
    update (s_wait)
    endrung

// ask boost after dwell
  eval (t_boost_done or j_boost)
    update (j_boost)
    endrung

// cut other side on nip
  eval (((t_dwell_done and Lwire) or Lcut) and not Rcut and not t_cut_done)
    update (Lcut)
  eval (((t_dwell_done and Rwire) or Rcut) and not Lcut and not t_cut_done)
    update (Rcut)
  eval (Lcut or Rcut)
    timerif (t_cut)
    endrung

// update not splicing signal
//  eval ((not j_change) or Lcut or Rcut)
//     update (NSplice)
//     endrung

  setouts (theVar)
endproc (ladder)

// end of ladder.c
/* plc.h - first shot at plc generator */

/* plc configuration */
#define dplcTCBytes     16
#define dplcTCWords     16
#define dplcBytes      128
#define dplcWords      128
#define dplcInputBits   24
#define dplcOutputBits  24
#define dplcSystemBits  40
#define dplcDoneBits    (dplcTCBytes+dplcTCWords)
#define dplcResrvBits    8
```

- 36 -

```
#define dplcInputBase  0
#define dplcOutputBase (dplcInputBase  +dplcInputBits)
#define dplcSystemBase (dplcOutputBase +dplcOutputBits)
#define dplcBDoneBase  (dplcSystemBase +dplcSystemBits)
#define dplcWDoneBase  (dplcBDoneBase  +dplcTCBytes)
#define dplcResrvBase  120
#define dplcTotalBits  (dplcResrvBase  +dplcResrvBits)

#if dplcTotalBits>128
#error too many bit variables defined
#endif

/* plc memory definition */
#ifdef __BORLANDC__
#include "plcb.h"
#else
#include "plca.h"
#endif

#define off 0
#define on 1
#define not !
#define and &&
#define or ||
#define xor ^

#define setproc(n) n##_func(1,1);
#define proc(t,n) n##_func(1,0);
#define step(n) n##_func(0,1);
#define dispatch(t,n) if(t) { n(); continue; }

#define defloop(t) while (t) {
#define endloop }

#define eval(c) lplcstat=(c);
#define update(b) b=lplcstat;
#define onif(b) if(lplcstat) b=1;
#define offif(b) if(lplcstat) b=0;
#define togif(b) if(lplcstat) b=!b;

#define loadif(k) lplcacc=k;
#define saveif(v) v=lplcacc;

#define timerif(t) \
  if(lplcstat) { \
    t+=plcTocks; t##_done=(t>=t##_cons); \
  } else { t=0; t##_done=0; \
  }

#define endrung if (lplcstep) if (suspend(&lplcaddr)) return;

#define defproc(n) \
 void n##_func(unsigned char lplcstart, unsigned char lplcstep) { \
  static near unsigned short lplcaddr; \
  static near unsigned char lplcstat; \
  static near unsigned short lplcacc; \
```

```
  lplcacc; \
  if ((lplcstart)||(!lplcaddr)) { \
    if (lplcstep) if (suspend(&lplcaddr)) return;
#define endproc(n) \
    lplcaddr=0; \
    return; \
  } else { if (resume(&lplcaddr)) lplcstat=0;} \
  return; \
}

#define defroot int main() { \
  static near unsigned char lplcstat; \
  static near unsigned short lplcacc; \
  lplcacc;
#define endroot return 0; }
#define setroot(v) \
  initio(v); \
  starttime();

#define getins(v) getio(v);
#define setouts(v) setio(v);
#define getticks gettime();

/* end of plc.h */

/* plc.c - unwind application */

#include <dacs.h>
#include <adcs.h>

#include "plc.h"
#include "ladder.h"

#define  SIGSOFT
#include "signal.i"

far unsigned long lacc;
far signed long sacc;

far unsigned char  pid_dtick;
far unsigned short pid_mtime;
far signed short   pid_dlast;
far signed long    pid_integ;
void doPID() {
  unsigned short posit;
  signed short i,j,k;
  signed long acc;

  adc_start(8,0);
  while (!adc_ready(8));
  posit=adc_value(8);
// update position, error
// raw error/dead error/deriv base in i/j/k
  if (ppb_edv) k=vpw_error;
  else k=vpw_posit;
  vpw_posit=posit;
  j=ppw_set-posit;
```

```
    if (ppb_dead) {
      i=j;
      if (j<0) i=-i;
      if (i<=ppb_dead) j=0;
    }
    i=ppw_set-j;
    vpw_error=j;

    if (posit<ppw_top) j_topped=1; else j_topped=0;
    if (!pid_dtick--) {
      pid_dtick=ppb_drate;
      acc=pid_dlast-k;
      pid_dlast=k;
      k=vpw_deriv;
      vpw_deriv=acc;
    }
  // dont update if forced dac
    if (vpb_force) {
  // motors off if something wrong,
    } else if ((!Stop)||(!i_Cstop)) {
      Torq0=0; Boost=0; j_boost=0; j_assist=0;
      if (!Tension) vpw_corr=0;
      else vpw_corr=ppw_stop;
  // boost if needed until moving up
    } else if (j_boost) {
      if ((int)vpw_deriv>0) {
        j_boost=0; Torq0=0;
      } else {
        vpw_corr=0; Torq0=1; Boost=1; j_assist=1;
      }
  // off during roll change
    } else if (j_change) {
      Torq0=0; Boost=0;
      pid_integ=ppw_dint+pab_assist;
      pid_integ=pid_integ<<16;
      if (psw_gain) vsw_gain=psw_dgain;
  // assist off on high integral or top of dancer or disable
  // boost if too low and going lower
    } else {
      sacc=pid_integ>>16; sacc=sacc*vsw_gain; sacc=sacc>>8;
      j=sacc&0xffff;
      if (j_assist) {
        if (j_topped||!i_Cenab||j>paw_assoff) {
          j_assist=0; Boost=0;
          sacc=pab_assist; sacc=sacc<<16;
          pid_integ=pid_integ-sacc;
        } else {
          if ((vpw_posit>paw_toolow)&&((int)vpw_deriv<0)) j_boost=1;
        }
  // on for low integral
      } else if ((j<paw_asson)&&i_Cenab&&!j_topped) {
        j_assist=1; Boost=1;
        sacc=pab_assist; sacc=sacc<<16;
        pid_integ=pid_integ+sacc;
      }
  // derivative term = Dd(0)-Sd(-1)
      sacc=ppw_dfact;
```

- 39 -

```
    acc=sacc*(int)vpw_deriv;
    sacc=k;
    sacc=sacc*(int)ppw_sfact;
    acc=acc-sacc;

// proportional term = W*set-position(0)
    if (vpw_error) {
      sacc=i;
      sacc=sacc<<8;
      acc=acc-sacc;
      sacc=ppw_setw;
      sacc=sacc*ppw_set;
      acc=acc+sacc;
    }

// include integral
    sacc=pid_integ/256;
    acc=acc+sacc;

// apply proportional factor
    acc=acc*ppw_pfact;
    acc=acc/0x10000;
    if (psw_gain) {
      acc=acc*vsw_gain;
      acc=acc/0x100;
    }

// clip at saturation
    if (ppb_lim) {
      if (acc<0) i=0;
      else if (acc>ppw_sat) i=ppw_sat;
      else i=acc;
    }

    acc=acc-i;
    acc=acc*ppw_wfact;

    if (ppb_rev) i=-i;
    vpw_corr=i;

// apply antiwindup
    acc=acc<<8;
    pid_integ=pid_integ-acc;

// and update integral
    acc=(int)vpw_error;
    acc=acc*ppw_ifact;
    acc=acc+pid_integ;

// and clip
    sacc=(int)ppw_lsat; sacc=sacc<<16;
    if (acc<sacc) acc=sacc;
    else {
      sacc=(int)ppw_hsat; sacc=sacc<<16;
      if (acc>sacc) acc=sacc;
    }
    pid_integ=acc;
```

- 40 -

```
      vpw_integ=pid_integ>>8;
    }

    dac_set(1,vpw_corr);

  // motor off if web stalled
    if (j_zero) {
      if (j_assist&&!(j_boost)) {
        if (pid_mtime<paw_tomot) pid_mtime++;
        else { Boost=0; j_assist=0; }
      } else
        if (vpw_posit>paw_toolow) pid_mtime=0;
    } else pid_mtime=0;

  }

  far unsigned short highClock;

  far unsigned long lastRef;      // reference variables
  far unsigned long refInterval;
  far unsigned long lastRefA;
  far unsigned long refAInt;

  far unsigned long thisTime;     // roll data
  far unsigned long thisBase;
  far unsigned char thisCount;
  far unsigned char zCount;

  far unsigned short rollStub;     // portion of ref interval
  far unsigned char lastCount;

  void checkDiam() {
    if ((!j_stop)&&(!j_manual)) {
      if (!j_alarm&&(vsw_radius<(vsw_splice+psw_almoff)))
        j_alarm=1;
      if (vsw_radius<(vsw_splice+psw_hotoff)) j_heat=1;
      else { j_heat=0; j_splice=0; }
      if (!j_splice&&(vsw_radius<vsw_splice)) {
        if (zCount++>pcb_okct) {
          j_heat=1; j_splice=1; zCount=0;
        }
      }
    }
  }
  int doRoll() {
    unsigned long t;
    int r;
    r=0;
    if (not j_zero) {
      t=(thisTime-thisBase)*256;
      if (i_altref) t=t/refAInt;
      else t=t/refInterval;
      lacc=t+rollStub+((thisCount-lastCount)*256);
      rollStub=256-t;
      t=lacc*psw_refsiz; // mil*256 circum
      t=t/256;
      t=t*10430; // 10000h/2pi
```

```
        t=t/0x10000;
        lastCount=thisCount+1;
        vsw_wrap++;
        if (j_stop) {
          if (zCount++>pcb_okct) {
                j_stop=0; zCount=0;
          }
        } else {
          if (t<24000) {
            vsw_radius=t;
            if (psw_gain) {
              t=t-psw_minrad;
              t=t*psw_gain;
              t=t/256;
              vsw_gain=t+256;
            }
            r=1;
          }
        }
      }
      return r;
    }
    void doRef() {
      if (!i_altref)
        if (j_zero) {
          if (zCount++>pcb_okct) {
            j_zero=0; zCount=0;
          }
        }
    }
    void doRefa() {
      if (i_altref)
        if (j_zero) {
          if (zCount++>pcb_okct) {
            j_zero=0; zCount=0;
          }
        }
    }
    static unsigned char CCL4  @ 0xce; /*capture left*/
    static unsigned char CCH4  @ 0xcf;
    void doDead() {
      unsigned long l;
      di(); l=highClock; CCL4=0; ei();
      l=l<<8; l=l+CCH4; l=l<<8; l=l+CCL4;
      if (i_altref) lacc=lastRefA;
      else lacc=lastRef;
      lacc=l-lacc; lacc=lacc>>8;
      if (!(lacc>>8))
        if ((lacc&0xff)>pcb_dead) {
          j_zero=1; j_stop=1;
          if (i_altref) lastRefA=l;
          else lastRef=l;
        }
      if ((j_stop)&&(!j_splice)&&(!j_manual)) j_heat=0;
    }

    far unsigned short lradius;
```

- 42 -

```
far unsigned short lwrap;
void doTTS() {
  unsigned char c;

  lacc=psw_refsiz; // i 1000
  lacc=lacc<<16; // i 1000 $10000
  if (i_altref) lacc=lacc/refAInt;
  else lacc=lacc/refInterval; // i $10000 6 / m 60 1000
  lacc=lacc*39; // ipm *$100
  vsw_web=lacc/0x1C0; // in ipm
  if ((!lradius)&&(!j_stop)) {
    vsw_calip=psb_acal;
    lradius=vsw_radius;
    lwrap=vsw_wrap;
  } else {
    if (vsw_radius<lradius) {
      lacc=lradius; lacc=lacc-vsw_radius;
      if (lacc>100*psb_ical) {
      lacc=lacc*0x10000;
      lacc=lacc/(vsw_wrap-lwrap);
      lacc=lacc*10;
      vsw_calip=lacc/0x10000; // in .0001i
      lradius=vsw_radius; lwrap=vsw_wrap;
      }
    }
  }
  lacc=(long)vsw_radius*vsw_radius-(long)vsw_splice*vsw_splice;
  lacc=lacc/(unsigned short)vsw_calip;
  c=0; vsw_time=0xffff;
  if (lacc&0xffff0000) { lacc=lacc/0x100; c=1; }
  lacc=lacc*1884;
  lacc=lacc/(unsigned short)vsw_web;
  if (c) lacc=lacc*65;  // *256/1000
  else { lacc=lacc*256/1000; } // /1000
  if (!(lacc&0xff000000)) vsw_time=lacc/0x100;

}

void doHertz() {
  vsw_splice=key_thumb()*50;
  if (!j_stop) {
    sacc=refInterval; sacc=sacc-refAInt;
    if (sacc<0) sacc=-sacc;
    sacc=sacc*100;
    if (i_altref) sacc=sacc/refAInt;
    else sacc=sacc/refInterval;
    Referr=!(sacc>pcb_referr);
  }
}

/*-----------------------------------------------------*/
#ifndef __BORLANDC__
static unsigned char CCEN  @ 0xc1; /*enables*/
static unsigned char CTCON @ 0xe1; /*scaling*/
static unsigned char T2CON @ 0xc8;
static unsigned char CC4EN @ 0xc9;
static unsigned char CRCL  @ 0xca; /*capture right*/
```

- 43 -

```
static unsigned char CRCH  @ 0xcb;
static unsigned char CCL1  @ 0xc2; /*capture refer*/
static unsigned char CCH1  @ 0xc3;
static unsigned char CCL2  @ 0xc4; /*capture altref*/
static unsigned char CCH2  @ 0xc5;
static unsigned char CCL3  @ 0xc6; /*capture left*/
static unsigned char CCH3  @ 0xc7;
static bit unsigned char EX3  @ 0xba;
static bit unsigned char EX4  @ 0xbb;
static bit unsigned char EX5  @ 0xbc;
static bit unsigned char EX6  @ 0xbd;
static bit unsigned char T2PS @ 0xcf;
static bit unsigned char I3FR @ 0xce;
static bit unsigned char I2FR @ 0xcd;
static bit unsigned char T2R1 @ 0xcc;
static bit unsigned char T2R0 @ 0xcb;
static bit unsigned char T2CM @ 0xca;
static bit unsigned char T2I1 @ 0xc9;
static bit unsigned char T2I0 @ 0xc8;
static bit unsigned char TF2  @ 0xc6;
static bit unsigned char ET2  @ 0xad;
void startisrs() {
  CCEN=0x55; CC4EN=0x06;
  CTCON|=0x80; T2PS=1;
  T2I1=0; T2I0=1; T2R1=0; T2CM=0;
  I3FR=1; EX3=1; EX4=1; EX5=1; EX6=1; ET2=1;
}

void interrupt isr_t2oflow() {
  highClock++;
  TF2=0;
}

/* void interrupt isr_leftroll() /* {
  vsb_left++;
  if (s_left) {
    di(); longone.b.h=highClock; ei();
    longone.b.l1=CCH3;
    longone.b.l0=CCL3;
    thisTime=longone.l;
    thisBase=lastRef;
    thisCount=vsb_ref;
    d_roll=1;
  }
}
void interrupt isr_rightroll() {
  vsb_right++;
  if (!s_left) {
    di(); longone.b.h=highClock; ei();
    longone.b.l1=CRCH;
    longone.b.l0=CRCL;
    thisTime=longone.l;
    thisBase=lastRef;
    thisCount=vsb_ref;
    d_roll=1;
  }
} */
```

- 44 -

```
void interrupt isr_leftroll() {
  vsb_left++;
  if (s_left) {
    d_roll=1;
#asm
      push  5
      push  4
      push  3
      push  2

      mov   a,199  ; CCH3
      mov   r4,a
      mov   a,198  ; CCL3
      mov   r5,a
myl099:
      mov   dptr,#_highClock   ;   save thisTime;
      movx  a,@dptr
        mov     r2,a
      inc   dptr
      movx  a,@dptr
        mov     r3,a
      mov   dptr,#_thisTime   ;   save thisTime;
        mov     a,r2
      movx  @dptr,a
      inc   dptr
      mov   a,r3
      movx  @dptr,a
      inc   dptr
      mov   a,r4
      movx  @dptr,a
      inc   dptr
      mov   a,r5
      movx  @dptr,a

      mov   dptr,#_lastRefA    ;   thisBase=lastRef;
      bb    20h.4,myl199   ;26h.4,u301
      mov   dptr,#_lastRef    ;   thisBase=lastRef;
myl199:
      movx    a,@dptr
      mov   r2,a
      inc     dptr
      movx    a,@dptr
      mov   r3,a
      inc     dptr
      movx    a,@dptr
      mov   r4,a
      inc     dptr
      movx    a,@dptr
      mov   r5,a
      mov   dptr,#_thisBase
      mov   a,r2
      movx  @dptr,a
      inc   dptr
      mov   a,r3
      movx  @dptr,a
      inc   dptr
      mov   a,r4
```

```
        movx  @dptr,a
        inc   dptr
        mov   a,r5
        movx  @dptr,a

        mov   dptr,#_vsb_refa   ;   thisCount=vsb_ref;
        bb    20h.4,myl299   ;26h.4,u301
        mov   dptr,#_vsb_ref   ;   thisCount=vsb_ref;
 myl299:
        movx  a,@dptr
        mov   dptr,#_thisCount
        movx  @dptr,a
        pop   2
        pop   3
        pop   4
        pop   5
 #endasm
   }
 }
 void interrupt isr_rightroll() {
   vsb_right++;
   if (!s_left) {
     d_roll=1;
 #asm
       push  5
       push  4
       push  3
       push  2

       mov   a,203  ; CRCH
       mov   r4,a
       mov   a,202  ; CRCL
       mov   r5,a
       jmp     myl099
 #endasm
   }
 }

 /*
 void interrupt isr_reference() {
   vsb_ref++;
   di(); longone.b.h=highClock; ei();
   longone.b.l1=CCH1;
   longone.b.l0=CCL1;
   refInterval=longone.l-lastRef;
   lastRef=longone.l;
   vsb_ref++;
   d_ref=1;
 }
 */
 void interrupt isr_reference() {
   vsb_ref++;
   d_ref=1;
 #asm
       push  5
       push  4
       push  3
```

- 46 -

```
push  2

mov   dptr,#_lastRef     ; get lastRef;
movx    a,@dptr
mov   r2,a
inc     dptr
movx    a,@dptr
mov   r3,a
inc     dptr
movx    a,@dptr
mov   r4,a
inc     dptr
movx    a,@dptr
mov   r5,a

  push    3
  push    2
mov   dptr,#_highClock    ; new lastRef
movx  a,@dptr
  mov     r2,a
inc   dptr
movx  a,@dptr
  mov     r3,a
mov   dptr,#_lastRef
mov   a,r2
movx  @dptr,a
inc   dptr
mov   a,r3
movx  @dptr,a
inc   dptr
mov   a,195   ; CCH1
movx  @dptr,a
inc   dptr
mov   a,194   ; CCL1
movx  @dptr,a
  pop     2
  pop     3
clr   c
mov   dptr,#_lastRef+3 ; interval is new-old
movx  a,@dptr
inc   dptr
subb  a,r5
mov   r5,a
mov   dptr,#_lastRef+2
movx  a,@dptr
inc   dptr
subb  a,r4
mov   r4,a
mov   dptr,#_lastRef+1
movx  a,@dptr
inc   dptr
subb  a,r3
mov   r3,a
mov   dptr,#_lastRef
movx  a,@dptr
inc   dptr
subb  a,r2
```

```
        mov   r2,a

        mov   dptr,#_refInterval
        mov   a,r2
        movx  @dptr,a
        inc   dptr
        mov   a,r3
        movx  @dptr,a
        inc   dptr
        mov   a,r4
        movx  @dptr,a
        inc   dptr
        mov   a,r5
        movx  @dptr,a

        pop   2
        pop   3
        pop   4
        pop   5
#endasm
}
void interrupt isr_refera() {
  vsb_refa++;
  d_refa=1;
#asm
        push  5
        push  4
        push  3
        push  2

        mov   dptr,#_lastRefA     ; get lastRef;
        movx    a,@dptr
        mov   r2,a
        inc     dptr
        movx    a,@dptr
        mov   r3,a
        inc     dptr
        movx    a,@dptr
        mov   r4,a
        inc     dptr
        movx    a,@dptr
        mov   r5,a

          push    3
          push    2
        mov   dptr,#_highClock    ; new lastRef
        movx  a,@dptr
          mov     r2,a
        inc   dptr
        movx  a,@dptr
          mov     r3,a
        mov   dptr,#_lastRefA
        mov   a,r2
        movx  @dptr,a
        inc   dptr
        mov   a,r3
        movx  @dptr,a
```

```
        inc   dptr
        mov   a,197  ; CCH2
        movx  @dptr,a
        inc   dptr
        mov   a,196  ; CCL2
        movx  @dptr,a
          pop     2
          pop     3
        clr   c
        mov   dptr,#_lastRefA+3 ; interval is new-old
        movx  a,@dptr
        inc   dptr
        subb  a,r5
        mov   r5,a
        mov   dptr,#_lastRefA+2
        movx  a,@dptr
        inc   dptr
        subb  a,r4
        mov   r4,a
        mov   dptr,#_lastRefA+1
        movx  a,@dptr
        inc   dptr
        subb  a,r3
        mov   r3,a
        mov   dptr,#_lastRefA
        movx  a,@dptr
        inc   dptr
        subb  a,r2
        mov   r2,a

        mov   dptr,#_refAInt
        mov   a,r2
        movx  @dptr,a
        inc   dptr
        mov   a,r3
        movx  @dptr,a
        inc   dptr
        mov   a,r4
        movx  @dptr,a
        inc   dptr
        mov   a,r5
        movx  @dptr,a

        pop   2
        pop   3
        pop   4
        pop   5
#endasm
}

/*-----------------------------------------*/
/* define interrupt service */
begvectors
  setvector (TF2vect,isr_t2oflow)    /* timer 2 overflow */
  setvector (EX4vect,isr_reference)  /* port 1.1 */
  setvector (EX5vect,isr_refera)     /* port 1.2 */
  setvector (EX3vect,isr_rightroll)  /* port 1.0 */
```

```
  setvector (EX6vect,isr_leftroll)  /* port 1.3 */
endvectors     /* rtc is on EX2 ..     port 1.4 */

#endif

/*-----------------------------------------*/
//static bit unsigned char WDout @ 0xb5;
/* dispatching root */
defroot (theVar);
  startisrs();

  adc_start(8,0);
  while (!adc_ready(8));
  vpw_posit=adc_value(8);
  pid_integ=ppw_dint;
  pid_integ=pid_integ<<16;
  vsw_gain=psw_dgain;

  dac_init();
  setroot (theVar)
  setproc (ladder)

  adc_start(8,0);
  while (!adc_ready(8));
  vpw_posit=adc_value(8);
  pid_integ=ppw_dint;
  pid_integ=pid_integ<<16;
  vsw_gain=psw_dgain;
  Referr=1;

  defloop (on)

//WDout=~WDout;
    if (clock128th) {
      clock128th=0;
      doPID();
      isrf_checkPort();
      isrf_checkPack();
      continue;
    }
    if (clock32th) {
      clock32th=0;
      continue;
    }
    if (clock1th) {
      clock1th=0;
      doTTS();
      doHertz();
      continue;
    }
    if (d_ref) {
      d_ref=0;
      doRef();
      continue;
    }
    if (d_refa) {
      d_refa=0;
```

- 50 -

```
      doRefa();
      continue;
    }
    if (d_roll) {
      d_roll=0;
      if (doRoll())
        checkDiam();
      continue;
    }
    doDead();
    step (ladder)
  endloop

endroot
/* end of plc.c */
/* plca.h - avocet macros and functions */

#include <intrpt.h>

static bit unsigned char Debug0 @ 0x92;

/* variable definition macros -------- */
#define dplcBitBytes ((dplcTotalBits+7)/8)
#define dplcBitBase   0x0020
#define dplcVarBase   0xf800
#define dplcVarSize   0x0100
#define dplcBytevBase 0xf800
#define dplcBytekBase 0xf810
#define dplcWordvBase 0xf820
#define dplcWordkBase 0xf840
#define dplcByteBase  0xf880
#define dplcWordBase  0xf900

/* variable control type ------------ */
typedef struct {
  unsigned char type,numb,jour;
  far void *addr;
  short init;
  char name[15];
} splcVar;

/* public variables ------------------ */
extern far unsigned char plcTocks;

static bit unsigned char clock128th @ dplcResrvBase+0;
static bit unsigned char clock64th  @ dplcResrvBase+1;
static bit unsigned char clock32th  @ dplcResrvBase+2;
static bit unsigned char clock1th   @ dplcResrvBase+3;

/* misc support functions ------------ */
void isrf_jour(short a, short b);
//void isrf_log(char c, short d);
//void isrf_log1(char c, long l);
//void isrf_log4(char c, short d, short e, short f, short g);
//void isrf_dump(short a, short l);
//void isrf_put(unsigned char d);
//void isr_mon();
```

- 51 -

```
void isrf_checkPort();
void isrf_checkPack();

/* incremental execution functions ------ */
unsigned char resume(near unsigned short *v);
unsigned char suspend(near unsigned short *v);

/* io support functions ---------------- */
void getio(void *v);
void setio(void *v);
void initio(code splcVar *p);

/* interrupt support ------------------- */
#define IE0vect   03h
#define TF0vect   0bh
#define IE1vect   13h
#define TF1vect   1bh
#define RI0vect   23h
#define TF2vect   2bh
#define IADCvect  43h
#define EX2vect   4bh
#define EX3vect   53h
#define EX4vect   5bh
#define EX5vect   63h
#define EX6vect   6bh
#define RI1vect   83h
#define CTFvect   8bh

/* timer functions --------------------- */
void starttime();
void gettime();
void interrupt isr_tick();
void interrupt isr_debug();


#define begvectors void set_vectors() { \
   set_vector(EX2vect, isr_tick);
#define setvector(v,f) set_vector(v,f);
//#define endvectors set_vector(IE1vect, isr_debug); }
#define endvectors }

/* end of plca.h */
/* plca.c - avocet macros and functions */

#include <prom.h>
#include <console.h>
#include <hexes.h>
#include "plc.h"

far unsigned char plcTicks;
far unsigned char plcTocks;
near unsigned char plc64th;
near unsigned char plc32th;
near unsigned char plc1th;

// misc support functions ----------
#define RTCBASE 0x7e40
```

- 52 -

```
unsigned char splcRomGet(short a) {
  unsigned char d;
  if (a&0xff00) d=*(far unsigned char*)(RTCBASE+14+(a&0x00ff));
  else prom_read(a,&d);
  return d;
}
void splcRomPut(short a, byte d) {
  if (a&0xff00) *(far unsigned char*)(RTCBASE+14+(a&0x00ff))=d;
  else {
    prom_enable();
    prom_write(a,d);
    prom_disable();
  }
}

// mapped address space
//  8000..8fff is external ram (xram)
//  0800..7fff is code rom
//  0400..07ff is code rom 0000..03ff
//  0100..03ff is nv ram
//  0000..00ff is ram
void isrf_poker(word a, byte d) {
  if (a&0x8000) *(far unsigned char*)a=d;
  else if (a&0x7c00) ;
  else if (a&0x0300) splcRomPut(a-0x0100,d);
  else *(near unsigned char*)a=d;
}
byte isrf_peeker(word a) {
  byte d;
  if (a&0x8000) d=*(far unsigned char*)a;
  else if (a&0x7800) d=*(code unsigned char*)a;
  else if (a&0x0400) d=*(code unsigned char*)(a-0x0400);
  else if (a&0x0300) d=splcRomGet(a-0x0100);
  else d=*(near unsigned char*)a;
  return d;
}
void isrf_dump(short a, short l) {
  byte b;
  cons_nl();
  while (l) {
    if ((a&0x000f)==0) {
      cons_nl(); puthexword(a); cons_put(':');
    }
    if ((a&0x0003)==0) cons_put(' ');
    puthexbyte(isrf_peeker(a));
    a++; l--;
  }
}
void isrf_snap() {
  isrf_dump(0x0000,0x0100);
  isrf_dump(0x0100,0x0132);
  isrf_dump(0xf800,0x0140);
  isrf_dump(0x8000,0x0140);
}
void isrf_put(unsigned char d) {
  if (d==0x0d) cons_cr();
  else cons_put(d);
```

```
}

// realtime packet support
// packet format [..]
// commands
//   =  set base to AA
//   <  modify @base to D
//   >  peek byte @base
//   {  modify @base to DD
//   }  peek word @base
//   `  snap thru port
//   !  reset

static unsigned char   S1BUF    @ 0x9C;
static unsigned char   S1CON    @ 0x9B;

static far unsigned char  packIx    @ 0xfff0;
static far unsigned char  packCmd   @ 0xfff1;
static far unsigned short packData  @ 0xfff2;
static far unsigned short packVars  @ 0xfff4;
static far unsigned short* far packJour  @ 0xfff6;
static far unsigned long  packOpto  @ 0xfff8;
static far unsigned short packBase  @ 0xfffc;
static far unsigned char  packWix   @ 0xfffe;
static far unsigned char  packSize  @ 0xffff;

void isrf_jour(short a, short b) {
  *packJour++=a; *packJour++=b;
  if ((short)packJour>0xefff)
    packJour=(far unsigned short*)0x8000;
}

void isrf_checkPort() {
  unsigned char b;
  if (S1CON&1) {
    S1CON&=0xfe; b=S1BUF;
    switch (packIx++) {
      case 0: if (b!='[') packIx=0; break;
      case 1: break;
      case 2:
        packCmd=b; packData=0;
        if (b=='<') packIx=4;
        else if ((b!='=')&&(b!='{')) packIx=5;
        break;
      case 3: packData=b; packData=packData<<8; break;
      case 4: packData=packData+b; break;
      case 5: if (b!=']') packIx=0; break;
      default: packIx=0;
    }
    if ((packIx!=1)&&(packIx!=6)) isrf_put(b);
  }
}
void isrf_checkPack() {
  if (packIx) {
    if (packIx==1) { packIx=2; cons_put('['); }
    else if (packIx==6) {
      switch (packCmd) {
```

- 54 -

```
        case '=': packBase=packData; break;
        case '<': isrf_poker(packBase++,packData); break;
        case '>': isrf_put(isrf_peeker(packBase++)); break;
        case '{':
          isrf_poker(packBase++,packData/256);
          isrf_poker(packBase++,packData&0xff);
          break;
        case '}':
          isrf_put(isrf_peeker(packBase++));
          isrf_put(isrf_peeker(packBase++));
          break;
        case '`': isrf_snap(); break;
        case '!':
          asm("  clr  a   ");
          asm("  push acc ");
          asm("  push acc ");
          asm("  reti     ");
          break;
      }
      packIx=0;
      cons_put(']');
    }
  } else {
    if (packSize) {
      if (!packWix) {
        cons_put('{'); packWix=1;
      } else if (packWix>packSize) {
      cons_put('}'); packWix=0;
      } else
      isrf_put(*(far unsigned char*)(packBase-1+packWix++));
    }
  }
}

/* incremental execution functions ------ */
static unsigned char stack @0x81;
unsigned char resume(near unsigned short *v) {
  near unsigned short *r;
  r=(near unsigned short*)(stack-1);
  *r=*v;
  return 0;
}
unsigned char suspend(near unsigned short *v) {
  near unsigned short *r;
  r=(near unsigned short*)(stack-1);
  *v=*r;
  return 1;
}

/* io support functions ----------- */
static near unsigned char port1 @ 0x90;
static near unsigned char port3 @ 0xb0;
static bit unsigned char port32 @ 0xb2;
static bit unsigned char port33 @ 0xb3;
static bit unsigned char port34 @ 0xb4;
static bit unsigned char port35 @ 0xb5;
static near unsigned char port4 @ 0xe8;
```

-55 -

```
static near unsigned char port5 @ 0xf8;
static near unsigned short inps0 @ 0x20;
static near unsigned char  inps2 @ 0x22;
static near unsigned short outs0 @ 0x23;
static near unsigned char  outs2 @ 0x25;
static far  unsigned short optoi @ 0x7e02;
static far  unsigned short optoo @ 0x7e00;

void getio(void *v) {
  inps2=~((port1&0xf0)|((port3&0x3c)>>2));
//  inps2=0;
  inps0=~optoi;
}
void setio(void *v) {
  if (packOpto) {
    port5=0xf0|((packOpto&0xf0)/16);
    port4=0xf0|((packOpto&0x0f));
//    port1=0x1f|(packOpto&0xe0);
//    port32=(packOpto&4)>>2;
//    port33=(packOpto&8)>>3;
//    port34=(packOpto&16)>>4;
//    port35=(packOpto&1);
    optoo=~((packOpto>>8)&0xffff);
  } else {
    port5=0Xf0|((outs2&0xf0)/16);
    port4=0xf0|((outs2&0x0f));
//    port1=0x1f|(outs2&0xe0); //rrot stop break
//    port3=0xc3&((outs2&0x3c)>>2);
//    port32=(outs2&4)>>2;  //alarm
//    port33=(outs2&8)>>3;  //torq
//    port34=(outs2&16)>>4; //boost
//    port35=(outs2&1);     //referr
    optoo=~outs0;
    *(far unsigned char*)(RTCBASE+0x3f)=
      *(near unsigned char*)
        (dplcBitBase+(dplcSystemBase+32)/8);
  }
}

void initio(code splcVar *p) {
  code splcVar *v;
  union {
   unsigned char dc[2];
   unsigned short ds;
  } d;
  far char *z;
  cons_open(1,BAUD096,1);
  z=(far char*)dplcVarBase; d.ds=0;
  while (d.ds++<dplcVarSize) *z++=0xff;
  prom_init();
  outs0=0; v=(code splcVar*)p;
  packVars=(unsigned short)p;
  packSize=0;
  packJour=(far unsigned short*)0x8000;
  packOpto=0;
  packIx=0;
  while (v->type!='z') {
```

```
      d.ds=0;
      if ((v->init)<0) {
        d.dc[1]=splcRomGet(-(v->init));
        if (v->numb==254)
    d.ds=(d.ds<<8)+splcRomGet(-(v->init)+1);
      } else {
    d.ds=v->init;
      }
      if ((v->numb)==254)
        *(far unsigned short*)(v->addr)=d.ds;
      else if ((v->numb)==255)
        *(far unsigned char*)(v->addr)=d.dc[1];
      else {
        if (d.dc[1])
    *(near unsigned char*)(dplcBitBase+(v->numb/8))|=(1<<(v->numb%8));
        else
    *(near unsigned char*)(dplcBitBase+(v->numb/8))&=~(1<<(v->numb%8));
      }
      v++;
    }
    *(near unsigned char*)
     (dplcBitBase+(dplcSystemBase+32)/8)=
       *(far unsigned char*)(RTCBASE+0x3f);
    setio(p);
    getio(p);
  }

  /* interrupt support -------------------- */
  static bit unsigned char IT1  @ 0x8a;
  static bit unsigned char EX1  @ 0xaa;
  static bit unsigned char EX2  @ 0xb9;
  static bit unsigned char I2FR @ 0xcd;

  /* timer functions ---------------------- */
  static far unsigned char RTCregA @ 0x7e4a;
  static far unsigned char RTCregB @ 0x7e4b;
  static far unsigned char RTCregC @ 0x7e4c;
  #define dplcTicksPer 13
  void starttime() {
    plc64th=1; plc32th=1; plc1th=1;
    I2FR=0;
    EX2=1;
  //  IT1=1;  // for debug
  //  EX1=1;
    RTCregA=0x29; RTCregB=0x40;
    if (RTCregC) plcTicks++;
    ei();
  }
  void gettime() {
    plcTocks=0;
    while (plcTicks>dplcTicksPer) {
      di();
      plcTicks-=dplcTicksPer;
      plcTocks++;
      ei();
    }
  }
```

```
void interrupt isr_tick() /*
{
  if (RTCregC) plcTicks++;
  clock128th=1;
  if (!--plc64th) {
    plc64th=2; clock64th=1;
    if (!--plc32th) {
      plc32th=2; clock32th=1;
      if (!--plc1th) {
      plc1th=32; clock1th=1;
      }
    }
  }
} */
{
#asm
      push  dpl
      push  dph

      mov   dptr,#32332 ; if (RTCregC) plcTicks++;
      movx  a,@dptr
      bz    myl74
        mov     dptr,#_plcTicks
        movx    a,@dptr
      inc   a
        movx    @dptr,a
myl74:
      setb  2Fh.0           ; clock128th=1;

      dbnz  _plc64th,myl75  ; if (!--plc64th) {
      mov   _plc64th,#2     ; plc64th=2; clock64th=1;
      setb  2Fh.1

      dbnz  _plc32th,myl75  ;   if (!--plc32th) {
      mov   _plc32th,#2     ;     plc32th=2; clock32th=1;
      setb  2Fh.2
      dbnz  _plc1th,myl75   ;     if (!--plc1th) {
      mov   _plc1th,#32     ;       plc1th=32; clock1th=1;
      setb  2Fh.3
myl75:                              ; }}}
      pop   dph
      pop   dpl
#endasm
}

void interrupt isr_debug() {
 isrf_snap();
}
/* end of plca.c */
```

The preferred embodiment of the present invention has now been described. This preferred embodiment constitutes the best mode presently contemplated by the inventors for carrying out their invention. Because the invention may be copied without copying the precise details of the preferred embodiment, the following claims particularly point out and distinctly claim the subject matter which the inventors regard as their invention and wish to protect:

We claim:

1. An improved method for controlling the speed and the tension of a web being unwound from a first, rotating roll where the web runs from the roll along a predetermined path through an inertia-compensated festoon, which has the capacity of storing varying amounts of running web during the operation of a web-using process without inducing tension variations into the web, and to the web-using process which requires the web to run at a preselected relatively high speed and at a preselected relatively low tension and which tends to pull the web so as to apply a web-unwinding torque to the roll; the method including the steps of:

applying a brake force to the rotating roll, when the web begins to unwind from the roll;

decreasing the braking force applied to the roll as the diameter of the roll is reduced, due to the web being unwound from the roll, so that the web will run through the process at the preselected speed and tension as the roll unwinds; and when the roll has been unwound to an intermediate diameter where the decreasing web-unwinding torque is inadequate to continue to accelerate the mass of the roll assisting in rotating the roll in a web-unwinding direction by adding web-unwinding torque to the roll as the diameter of the roll continues to decrease from the intermediate diameter so that the web will continue to run through the process at the preselected speed and tension as the remaining web is unwound from the roll.

2. The improved method of claim 1 where the amount of running web stored in the festoon determines the application of the brake force being applied to the roll and the adding of the assisting web-unwinding torque to the roll.

3. The improved method of claim 2 where the roll includes a first, center-core-shaft on which it is mounted and which rotates with the roll; where a first brake-assembly is connected with the core shaft and includes components which rotate with the core shaft; and where a first drive-assembly is connected with the core shaft and includes components which rotate with the core shaft; where the brake assembly applies braking force to the core shaft; and where the drive assembly adds the assisting web-unwinding torque to the core shaft.

4. The improved method of claim 3 where a second, then non-running roll is positioned for rotation adjacent to the beginning of the predetermined path of the web running from the first running-roll; where a zero-speed web-splicing assembly is positioned adjacent to the predetermined path, downstream from the rolls, and when actuated, serves to splice the leading end of the web wound on the non-running roll with the web being unwound from the running roll; where the second roll includes a second center-core-shaft and is mounted on the second center-core-shaft for rotation with the second roll; where a second shaft brake-assembly is connected with the second core-shaft and includes components which rotate with the second core-shaft; where a second shaft drive-assembly is also connected with the second core-shaft and includes components which rotate with the second core-shaft; where, when a web splice is to be made, the method includes the further steps of: increasing the braking force of the first brake-assembly on the second core-shaft of the first running-roll and disengaging the first drive-assembly so that the first running-roll will stop rotating; splicing the trailing end portion of the web on the first roll with the leading end portion of the web on the second roll in the splicing assembly; engaging the second drive-assembly with the second core-shaft so that after the web splice has been made by the splicing assembly, the second roll will be accelerated to line speed by the second drive-assembly and thereafter disengaging the second drive-assembly; and applying braking force, by the second brake-assembly, to the second core-shaft to control the running of the web from the second, now-running roll so that the web will run through the process at the preselected speed and tension.

5. The improved method of claim 4 where the amount of web stored on the festoon determines the application of the braking force being applied to the running roll, before the diameter of the running roll is unwound to its intermediate diameter and the adding of assisting web-unwinding torque to the running roll before the running roll is stopped for web splicing.

6. An improved system for controlling the speed and tension of a web running through a web-using production process which requires the web to run at a preselected relatively high speed and at a preselected low tension and which tends to pull the web so as to apply a web-unwinding torque to the roll, the system comprising:

a first roll mounted for rotation about its central longitudinal axis and having the web wound about its longitudinal axis, with the web, which is being unwound from the roll, running along a predetermined path from the roll to the process;

an inertia-compensated festoon disposed in the predetermined path so that the running web passes through the festoon, with the festoon having the capacity for storing varying amounts of running web during the operation of the process without inducing tension variations into the web;

a first shaft brake-assembly connected with the roll for applying a braking force to the roll;

a first shaft-drive assembly connected with the roll so that when engaged, the drive assembly will drive the roll in a web-unwinding direction;

means for controlling the operations of the brake assembly and of the drive assembly, with the control means causing the brake assembly to apply a decreasing braking force to the roll as the diameter of the roll decreases, due to the web being unwound therefrom, so that the running web will run through the process at the preselected speed and tension, and with the control means causing the drive assembly to engage the roll when the web on the roll has been unwound to an intermediate diameter where the decreasing web-unwinding torque is inadequate to continue to accelerate the mass of the roll so that the drive assembly will increasingly add assisting web-unwinding torque to the roll as the diameter of the roll continues to decrease so that the web will continue to run through the process at the preselected speed and tension as remaining web is unwound from the roll.

7. The improved system of claim 6 wherein the control means includes means for sensing the amount of web stored in the festoon; and wherein the sensed amount of web determines the application of the braking force by the brake assembly on the roll and the addition of assisting web-unwinding torque by the drive assembly to the roll.

8. The improved system of claim 7 wherein the first roll includes a first center-core-shaft on which it is mounted and which rotates with the roll; wherein the first brake assembly is connected with the first core-shaft, and includes components which rotate with the core shaft; and wherein the first drive-assembly is connected with the first core-shaft and includes components that rotate with the core shaft; wherein the first brake-assembly applies braking force to the first core-shaft; and wherein the first drive-assembly adds assisting web-unwinding torque to the first core-shaft.

9. The improved system of claim 8 wherein a second, then non-running roll, which includes a second center-core-shaft, is positioned for rotation with the second central core shaft; wherein the second roll is adjacent to the beginning of the predetermined path of the web running from the first running-roll; wherein a zero-speed web-splicing assembly is positioned adjacent to the predetermined path, downstream from the rolls and when actuated, serves to splice the leading end of the web wound on the non-running roll with the web being unwound from the running roll; wherein a second shaft-brake assembly is connected with the second core-shaft and includes components which rotate with the second core-shaft; wherein a second shaft drive-assembly is also connected with the second core-shaft and includes components which rotate with the second core shaft; wherein when a web splice is to be made, the control means increases the braking force of the brake assembly on the core-shaft of the running roll and disengages the drive assembly from the core-shaft of the running roll so that the running roll will stop rotating; wherein the control means causes the splicing assembly to splice the trailing-end portion of the web on the running roll to the leading-end portion of the web on the non-running roll; wherein after a web splice has then been made by the splicing assembly, the control means causes the drive assembly to accelerate the non-running, roll to line speed, after which the control means disengages that drive assembly; and wherein the control means causes the braking assembly associated with the now-running roll to apply braking force to control the running of the web from the now-running roll so that web will continue to run through the process at the preselected speed and tension.

10. The improved system of claim 9 wherein the control means includes means for sensing the amount of web stored in the festoon; and wherein the sensed amount of web determines the application of braking force to the running roll and the addition of assisting web-unwinding torque by the drive assembly of the running roll.

* * * * *